US007112349B2

(12) United States Patent
Lai

(10) Patent No.: US 7,112,349 B2
(45) Date of Patent: Sep. 26, 2006

(54) METHOD AND TREATING HINGE HOLDER

(75) Inventor: Wente Lai, Tu-chen (TW)

(73) Assignee: FIH Co., Ltd., Shindian (TW)

( * ) Notice: Subject to any disclaimer, the term of this patent is extended or adjusted under 35 U.S.C. 154(b) by 556 days.

(21) Appl. No.: 10/335,296

(22) Filed: Dec. 31, 2002

(65) Prior Publication Data

US 2004/0094423 A1 May 20, 2004

(51) Int. Cl.
*B05D 3/10* (2006.01)

(52) U.S. Cl. ..... 427/305; 427/318; 427/437; 427/443.1; 205/122; 205/207; 205/283

(58) Field of Classification Search ..... 427/437, 427/443.1, 304, 305, 318; 205/122, 207, 205/283

See application file for complete search history.

(56) References Cited

U.S. PATENT DOCUMENTS 4,931,366 A * 6/1990 Mullaney, Jr. ..... 428/622
5,480,536 A * 1/1996 Suehiro et al. ..... 205/151
5,761,769 A * 6/1998 Bruckner et al. ..... 16/342
6,274,200 B1 * 8/2001 Keener et al. ..... 427/318
6,560,821 B1 * 5/2003 Miller et al. ..... 16/252
2002/0072335 A1 * 6/2002 Watanabe ..... 455/90
2002/0182437 A1 * 12/2002 Adamou et al. ..... 428/679
2005/0030264 A1 * 2/2005 Tsuge et al. ..... 345/76

* cited by examiner

*Primary Examiner*—Bret Chen
(74) *Attorney, Agent, or Firm*—Wei Te Chung

(57) ABSTRACT

A method for treating a hinge holder includes the following steps: polishing a surface of the hinge holder; degreasing the hinge holder; cleaning the hinge holder; baking the hinge holder; cooling the hinge holder; screen-printing a part of the surface of the hinge holder; and plating the other part of the surface of the hinge holder with chromium or a chromium-containing compound. The plated hinge holder has a layer of chromium or chromium nitride on the surface, which renders the surface of the hinge holder more attractive and more wear-resistant. Therefore, it is not as easily scratched during assembly and frequent use.

19 Claims, 1 Drawing Sheet

METHOD AND TREATING HINGE HOLDER

BACKGROUND OF THE INVENTION

1. Field of the Invention

This invention generally relates to a method for treating surfaces of metal work pieces, and particularly to a method for treating a metal hinge holder of a hinge system for connecting two parts of a portable electronic device.

2. Prior Art

With the development of information technology, portable electronic devices, such as mobile phones and personal digital assistants, are becoming popular. Consumers especially like portable electronic devices which have an attractive appearance. Currently, flip covers are designed for most such portable electronic devices, since flip covers can protect key buttons from being damaged or accidently depressed. A hinge system comprising a hinge and a hinge holder are usually used to connect a main body of a portable electronic device with its flip cover. The hinge is mounted on an end of the flip cover and the hinge holder is mounted on an end of the main body. The hinge is coupled to the hinge holder such that the flip cover can rotate round the hinge.

Since the hinge holder is mounted on the end of the main body, the hinge holder may be partially exposed to an outside of the device. In order to make the appearance of the portable electronic device more attractive, the hinge holder is generally treated by polishing before being mounted to the main body of the portable electronic device. However, the polished surface of the hinge holder is susceptible to being scratched and damaged, which affects the appearance of the portable electronic device. Therefore, an improved method for treating a hinge holder is desired.

SUMMARY OF THE INVENTION

Accordingly, an object of the present invention is to provide a method for treating a surface of a hinge holder which renders the surface more attractive and more wear-resistant.

To achieve the above object, a method for treating a surface of a hinge holder according to the present invention comprises the steps of: polishing the surface of the hinge holder; degreasing the hinge holder with ultrasonic waves; cleaning the hinge holder with hot water; baking the hinge holder; cooling the hinge holder; and plating chromium on the hinge holder. The hinge holder treated by this process has an attractive, hard surface which is not easily scratched.

Other objects, advantages and novel features of the present invention will be drawn from the following detailed description of preferred embodiments of the present invention.

DETAILED DESCRIPTION OF THE INVENTION

Figure 1:
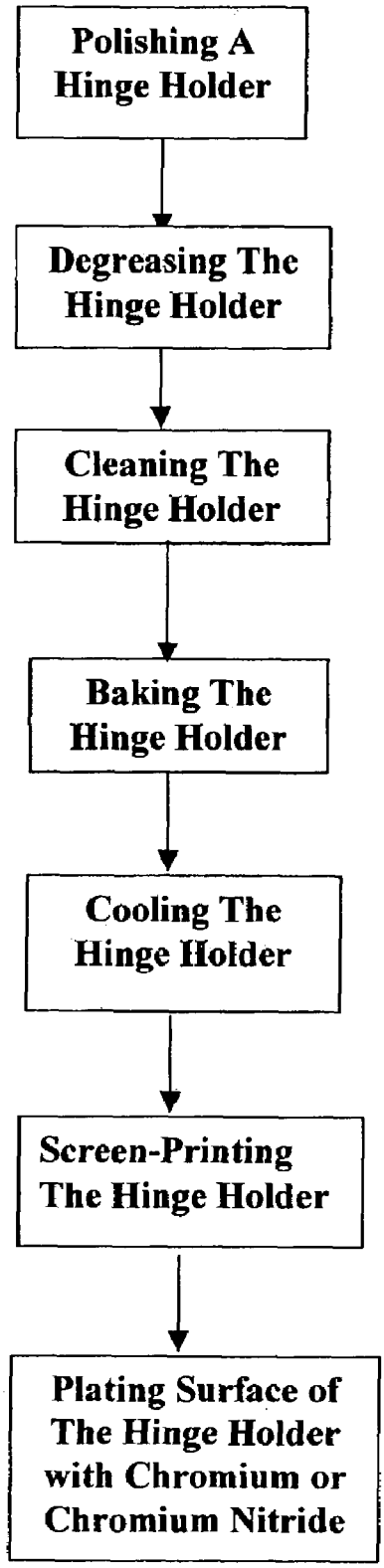
FIG. 1 is an illustrative flowchart showing a process for treating a hinge holder according to a method of the present invention.

Referring to FIG. 1, a method for treating a surface of a hinge holder will be described in more details as follows.

Firstly, the hinge holder is disposed in a mechanical polishing machine. One such machine has a power of 2500 to 3000 watts (W), a voltage of 360 to 390 volts (V) and draws an electrical current of 8 to 9 amperes (A). The mechanical polishing machine is adjusted to a speed of rotation of 2500 to 3000 round per minute (rpm) and is used to polish the hinge holder. Then, the hinge holder is immersed into an alkaline aqueous solution containing 5% sodium hydroxide (NaOH) by weight at a temperature of 70 to 80 degrees Celsius (° C.), after being polished.

Next, a wave generator is used to produce ultrasonic waves propagating in the alkaline aqueous solution to degrease the hinge holder. The ultrasonic waves have a frequency of 20 to 40 kilohertz (KHz). After that, the hinge holder is cleaned several times in hot water having a temperature of 60 to 80° C. The hinge holder is then put into an oven having a temperature of 60 to 80° C. and is baked for a period of 5 minutes. The hinge holder is then cooled and taken out of the oven.

Finally, the hinge holder is plated with chromium or a chromium-containing compound. Before plating, a part of the surface of the hinge holder has a covering of protective ink deposited on it by way of screen-printing. This protective ink prevents plating on the surfaces so covered. The other part of the surface is exposed for being plated with chromium or chromium-containing compound. Two examples of methods for plating chromium or a chromium-containing compound on the surface of the hinge holder are described below.

EXAMPLE 1

The hinge holder is put into a solution of 12% to 18% sulphuric acid ($H_2SO_4$) by weight and is thus activated. The hinge holder is washed in water thereafter. The hinge holder is then immersed into an electrolyte solution consisting of 800 to 850 grams per liter (g/L) $CrO_3$ and 8 grams per liter (g/L) $KIO_3$, with the electrolyte solution being kept at a temperature of 40 to 45° C. Next, the hinge holder is electroplated for a period of an hour with a cathode current density of 60 to 90 ampere per square decimeter ($A/dm^2$). The resulting layer of chromium is deposited on those portions of the surface of the hinge holder that are not covered by protective ink. The layer of chromium is about 200 μm thick.

EXAMPLE 2

Initially, the hinge holder is placed in a vacuum chamber of a vacuum deposition device. The hinge holder then undergoes a glow discharge cleaning step, wherein the vacuum chamber is charged with an inert gas such as argon to a pressure between $7.0\times10^{-3}$ and $9.0\times10^{-3}$ pascal (Pa), and a bias voltage in a range of −950 to −1100 V is applied to the hinge holder for initiating an abnormal glow discharge. The impingement of argon ions from this glow discharge onto the hinge holder cleans the surfaces to be coated. A second cleaning step is effected by decreasing the pressure to between $4.0\times10^{-3}$ Pa and $6.0\times10^{-3}$ Pa, so that the chromium ions from a chromium source bombard the surfaces of the hinge holder and sputter clean the surfaces.

When the surface of the hinge holder is thoroughly clean, the bias voltage on the hinge holder is reduced to a range between 0 volts and −500 volts for deposition of the coating, and nitrogen is then introduced into the vacuum chamber. During deposition, the nitrogen reacts with chromium ions to form CrN (chromium nitride), which is deposited on the surfaces. The ratio of argon to nitrogen, in effect the partial pressure of nitrogen, must be carefully controlled to minimize the deposition of pure Cr, partially reacted Cr, and possibly $Cr_2N$. Preferably, the ratio of argon to nitrogen is less than 0.8. Deposition in nitrogen alone is preferred. The CrN layer applied to the surface of the hinge holder has a thickness about 1 to 10 microns through a period about 30 minutes of deposition.

The plated hinge holder has a layer of chromium nitride on the surface, which renders the surface of the hinge holder more attractive and more wear-resistant. Therefore, it is not as easily scratched during assembly and frequent use.

It is believed that the present invention and its advantages will be understood from the foregoing description and it will be apparent that various changes may be made thereto without departing from the spirit and scope of the invention or sacrificing all of its material advantages, the examples hereinbefore described merely being preferred or exemplary embodiments of the invention.

We claim:

1. A method for treating a hinge holder used in a portable electronic device, comprising the steps of:

(1) polishing a surface of the hinge holder;
(2) degreasing the hinge holder and cleaning thereafter;
(3) baking the hinge holder;
(4) cooling the hinge holder;
(5) screen-printing a part of the surface of the hinge holder with a protective substance; and
(6) plating the other part of the surface of the hinge holder with a metal chosen from the group consisting of chromium and a chromium-containing compound.

2. The method of claim 1, wherein in step (6) the hinge holder is electroplated with a chromium compound in a vacuum.

3. The method of claim 1, wherein the hinge holder is electroplated with chromium in an electrolyte solution consisting of 800 to 850 grams per liter (g/L) $CrO_3$ and 8 grams per liter (g/L) $KIO_3$.

4. The method of claim 3, wherein the electrolyte solution is kept in a temperature range of 40 to 45 degrees Celsius and the hinge holder is electroplated for a period of an hour with a cathode current density of 60 to 90 ampere per square decimeter.

5. The method of claim 1, wherein in step (2) the hinge holder is immersed into an alkaline aqueous solution containing 5% sodium hydroxide (NaOH) by weight at a temperature of 70 to 80 degrees Celsius (° C.).

6. The method of claim 5, wherein the hinge holder is degreased in the alkaline aqueous solution using ultrasonic waves having a frequency of 20 to 40 kilohertz.

7. The method of claim 1, wherein in step (3) the hinge holder is baked at a temperature of 60 to 80 degrees Celsius (° C.).

8. The method of claim 1, wherein after step (6) is performed the hinge holder has a layer of chromium nitride on the other part of the surface thereof.

9. A method for treating a hinge holder used in a portable electronic device, comprising the steps of:

(1) polishing a surface of the hinge holder;
(2) degreasing the hinge holder and cleaning thereafter;
(3) baking the hinge holder;
(4) cooling the hinge holder;
(5) covering a portion of the surface of the hinge holder which is not to be plated with a protective ink; and
(6) depositing chromium nitride on a remainder of the surface of the hinge holder in a vacuum.

10. The method of claim 9, wherein, in step (1) the hinge holder is polished using a mechanical polishing machine having a power of 2500 to 3000 watts (W), a voltage of 360 to 390 volts (V) and drawing an electrical current of 8 to 9 amperes (A).

11. The method of claim 9, wherein, in step (6) the hinge holder is placed in a vacuum chamber for a glow discharge cleaning step, and the vacuum chamber is charged with inert gas to a pressure between $7.0\times10^{-3}$ and $9.0\times10^{-3}$ pascal(Pa).

12. The method of claim 9, wherein, after the surface of the hinge holder is thoroughly cleaned, a bias voltage on the hinge holder is reduced to a range between 0 volts and −500 volts during deposition, and nitrogen is introduced into the vacuum chamber.

13. The method of claim 9, wherein a thickness of a chromium nitride layer of the hinge holder is about 1 to 10 microns after a period of about 30 minutes of deposition.

14. The method of claim 9, wherein in step (1) the hinge holder is polished using a mechanical polishing machine having a speed of rotation in the range from 2500 to 3000 revolutions per minute (rpm).

15. The method of claim 9, wherein in step (2) the hinge holder is immersed into an alkaline aqueous solution containing 5% sodium hydroxide (NaOH) by weight at a temperature in the range from 70 to 80 degrees Celsius (° C.).

16. The method of claim 9, wherein the hinge holder is degreased in the alkaline aqueous solution using ultrasonic waves having a frequency in the range from 20 to 40 kilohertz.

17. The method of claim 9, wherein in step (3) the hinge holder is baked at a temperature in the range from 60 to 80 degrees Celsius (° C.).

18. A method for treating a hinge holder used in a portable electronic device, comprising the steps of:

(1) polishing a surface of the hinge holder;
(2) degreasing the hinge holder and cleaning thereafter;
(3) baking the hinge holder;
(4) cooling the hinge holder; and
(5) plating a designated portion of the surface of the hinge holder with a metal chosen from the group assentially consisting of chromium and a chromium-containing compound.

19. The method of claim 18, wherein in step (5) the hinge holder is electroplated in a vacuum.

* * * * *